US012594479B2

(12) United States Patent
Zeidman et al.

(10) Patent No.: US 12,594,479 B2
(45) Date of Patent: Apr. 7, 2026

(54) POOL LAP COUNTER

(71) Applicants: Robert M. Zeidman, Las Vegas, NV (US); Carrie L Zeidman, Las Vegas, NV (US); John Caldwell, Morgan Hill, CA (US)

(72) Inventors: Robert M. Zeidman, Las Vegas, NV (US); Carrie L Zeidman, Las Vegas, NV (US); John Caldwell, Morgan Hill, CA (US)

(73) Assignee: Z Enterprises, Las Vegas, NV (US)

( * ) Notice: Subject to any disclaimer, the term of this patent is extended or adjusted under 35 U.S.C. 154(b) by 530 days.

(21) Appl. No.: 18/120,899

(22) Filed: Mar. 13, 2023

(65) Prior Publication Data

US 2024/0307753 A1 Sep. 19, 2024

(51) Int. Cl.
*A63B 71/06* (2006.01)
*E04H 4/14* (2006.01)

(52) U.S. Cl.
CPC ..... *A63B 71/06* (2013.01); *E04H 4/14* (2013.01); *A63B 2071/0602* (2013.01); *A63B 2220/17* (2013.01); *A63B 2244/20* (2013.01)

(58) Field of Classification Search
CPC ..... A63B 71/06; A63B 2071/0602; A63B 2220/17; A63B 2244/20; A63B 71/0672; A63B 2071/0694; E04H 4/14
See application file for complete search history.

(56) References Cited

U.S. PATENT DOCUMENTS

| | | | | |
|---|---|---|---|---|
| 231,406 | A * | 8/1880 | Cooley | A63B 71/0672 235/128 |
| 1,144,487 | A * | 6/1915 | McGinley | G09B 19/02 434/203 |
| 3,526,045 | A | 9/1970 | Stone | |
| 3,944,763 | A | 3/1976 | Beierwaltes | |
| 3,989,298 | A | 11/1976 | Cycowicz | |
| 4,518,266 | A | 5/1985 | Dawley | |
| 4,700,369 | A | 10/1987 | Siegal | |
| 4,780,085 | A | 10/1988 | Malone | |
| 4,932,045 | A | 6/1990 | Kasoff | |
| 4,993,004 | A | 2/1991 | Loizeaux | |
| 5,136,621 | A | 8/1992 | Mitchell | |
| 5,285,428 | A | 2/1994 | Rosow | |
| 5,334,026 | A | 8/1994 | Ylitalo | |
| 5,725,380 | A | 3/1998 | Kennelly | |
| D462,629 | S | 9/2002 | Tran | |
| 7,029,170 | B2 | 4/2006 | Bailey | |
| 7,225,572 | B2 * | 6/2007 | Lowry | G09F 3/204 40/661.03 |
| 7,345,958 | B1 | 3/2008 | Kneafsey | |
| 7,641,590 | B2 | 1/2010 | Chan | |
| 8,373,548 | B2 | 2/2013 | Stewart | |

(Continued)

FOREIGN PATENT DOCUMENTS

| | | | | |
|---|---|---|---|---|
| EP | 2120125 | A1 * | 11/2009 | A63B 71/0672 |
| WO | WO-2012125114 | A1 * | 9/2012 | G07C 1/22 |

*Primary Examiner* — Kristina M Deherrera
*Assistant Examiner* — Tania Courson

(57) ABSTRACT

This invention is an inexpensive, easy-to-use, and easy-to-manufacture device that can be placed on the edge of a pool so that a swimmer can use it to count laps without significantly disrupting the swimming. The invention is lightweight and portable so that one person can carry it around, place it on the pool before swimming laps, and remove it afterwards.

4 Claims, 4 Drawing Sheets

(56) References Cited

U.S. PATENT DOCUMENTS

| | | | | |
|---|---|---|---|---|
| 8,406,085 | B2 | 3/2013 | Sakita | |
| 8,696,420 | B2 | 4/2014 | Mueller | |
| 9,217,634 | B1 | 12/2015 | Firmin | |
| 9,353,904 | B2 * | 5/2016 | Sun | G06F 1/16 |
| D812,131 | S | 3/2018 | Lengdorfer | |
| D813,306 | S * | 3/2018 | Rule | D19/62 |
| D851,050 | S * | 6/2019 | Maetani | D13/168 |
| 11,511,177 | B2 | 11/2022 | Zeidman | |
| 2005/0091893 | A1 * | 5/2005 | Bruegmann | G09F 15/00 40/606.15 |
| 2005/0239023 | A1 | 10/2005 | Watanabe | |
| 2005/0243651 | A1 | 11/2005 | Balley | |
| 2007/0076529 | A1 | 4/2007 | Lin | |
| 2007/0161472 | A1 | 7/2007 | Drechsler | |
| 2007/0182567 | A1 | 8/2007 | Stewart | |
| 2008/0171310 | A1 | 7/2008 | Wiles | |
| 2008/0280102 | A1 | 11/2008 | Brouard | |
| 2010/0019897 | A1 | 1/2010 | Stewart | |
| 2012/0028229 | A1 | 2/2012 | Harte | |
| 2017/0289668 | A1 | 10/2017 | Kim | |
| 2019/0369382 | A1 | 12/2019 | Chen | |

* cited by examiner

POOL LAP COUNTER

TECHNICAL FIELD

Embodiments of the present invention relate to a portable, inexpensive, easy-to-use, and easy-to-manufacture device for allowing a swimmer to keep count of the number of laps that have been swum.

BACKGROUND

When inventors Robert and Carrie Zeidman moved into a new house that had a swimming pool, they started swimming for regular exercise. Swimming is great cardio exercise as well as for developing the strength of muscles throughout the body. Plus it can be calming and relaxing. Carrie likes to clear her mind of thoughts while swimming while Robert prefers to consider problems and work on solutions while swimming. However, both found their thoughts to be tediously repeating the lap count in their heads, "one, one, one . . . two, two, two . . . three, three, three . . . " This counting defeated the mental effects they were looking for, and many times they would lose count, having to guess at which lap they were on. So they invented a simple lap counter that resulted in the invention described in U.S. Pat. No. 11,511,177.

When they manufactured the device, they worked with product designer John Caldwell, and the three of them realized they could make the invention more compact and more easily portable, resulting in the invention described in this specification.

BRIEF DESCRIPTION OF THE DRAWINGS

The present invention is illustrated by way of example, and not by way of limitation, in the figures of the accompanying drawings and in which.

DETAILED DESCRIPTION

Embodiments of the invention are directed to an apparatus for allowing a swimmer to count laps while swimming. Embodiments of the invention make use of a basic knowledge of mechanical engineering.

The present invention is a mechanical system for allowing a swimmer to count the number of laps that the swimmer swims in a pool.

Figure 1:
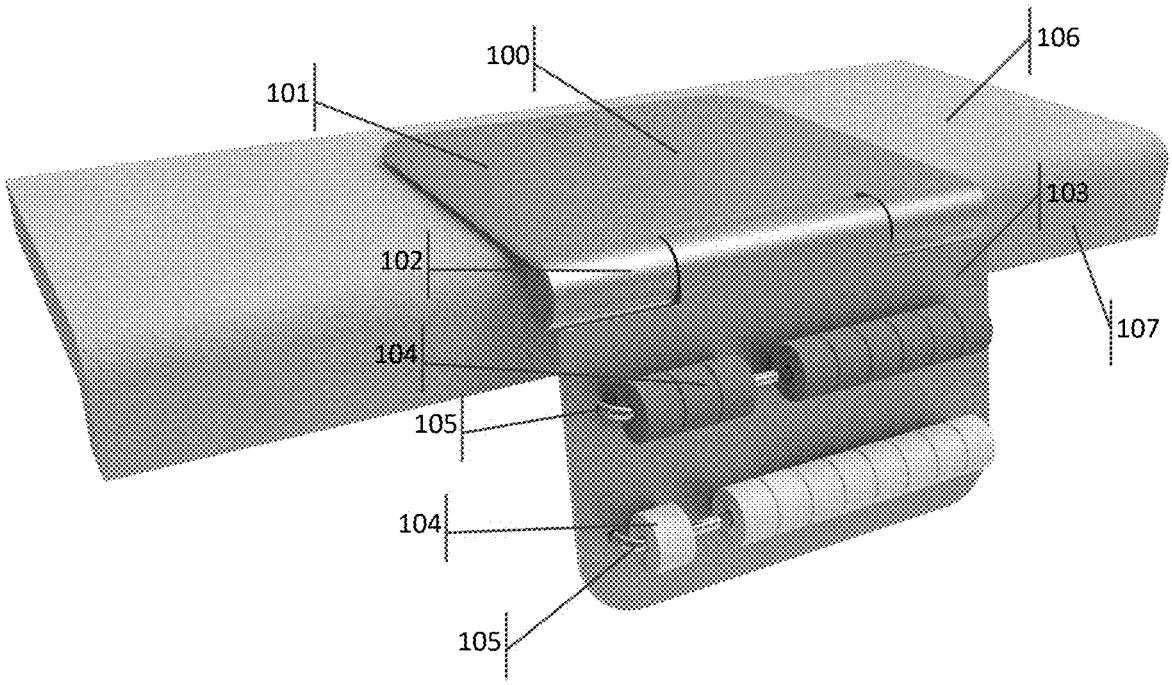
FIG. 1 shows one embodiment of the invention.

FIG. 1 shows one embodiment of Lap Counter 100 comprised of horizontal Base Plane 101, Hinge 102, vertical Count Plane 103, and one or more Sliding Counter 104 on one or more Rods 105. Base Plane 101 is configured to rest horizontally on Pool Deck 106. Base Plane 101 is integrated with Hinge 102 that is in turn integrated with Count Plane 103. Count Plane 103 is configured to rest vertically against Pool Wall 107.

Sliding Counter 104 is comprised of nine round sliders, each with a hole in the middle to enable sliding over Rod 105. Different embodiments of the present invention may have one or more instances of Sliding Counter 104 and one or more instances of Rod 105. The sliders can be slid right to left to indicate the number of laps swum. The user can use one instance of Sliding Counter 104 to represent single laps and another instance of Sliding Counter 104 to represent tens of laps.

In this embodiment, Rod 105 is mounted directly onto Count Plane 103. Rod 105 is a metal bar that is bent at right angles at both ends, which ends are attached to Count Plane 103. Hinge 102 allows the invention to be folded so that Base Plane 101 and Count Plane 103 are parallel for easy portability.

Figure 2:
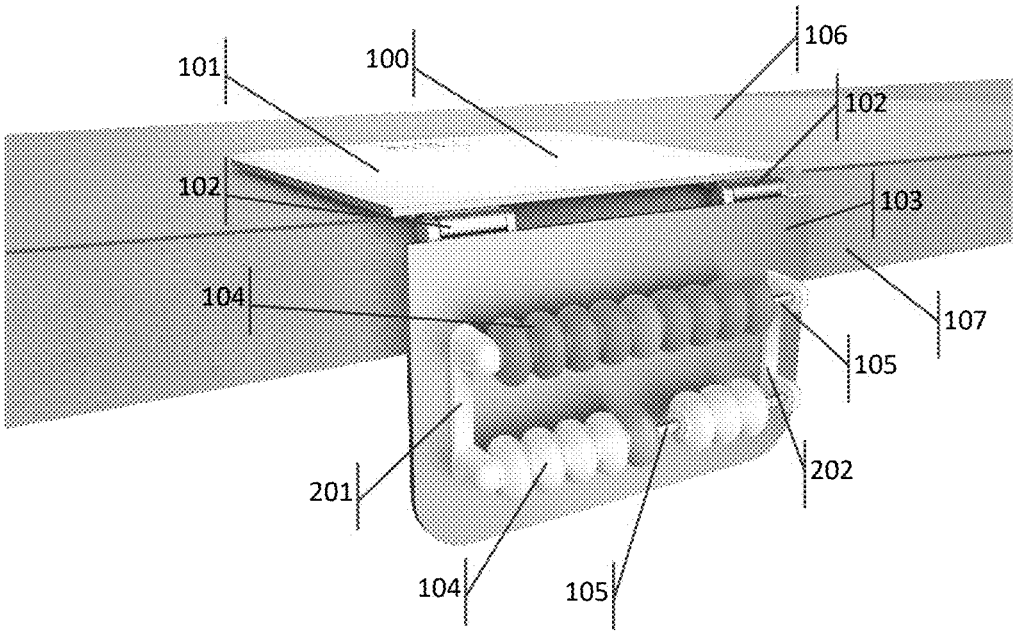
FIG. 2 shows another embodiment of the invention.

FIG. 2 shows another embodiment of Lap Counter 100 where Tab 201 and Tab 202 are attached, each at a right angle to Count Plane 103. In this embodiment, Rod 105 is straight and not bent at a right angle at each end. Each instance of Rod 105 is attached between, and held in place by, Tab 201 and Tab 202. Also, in this embodiment there are two instances of Hinge 102 that are both used to connect Base Plane 101 with Count Place 103.

Figure 4:
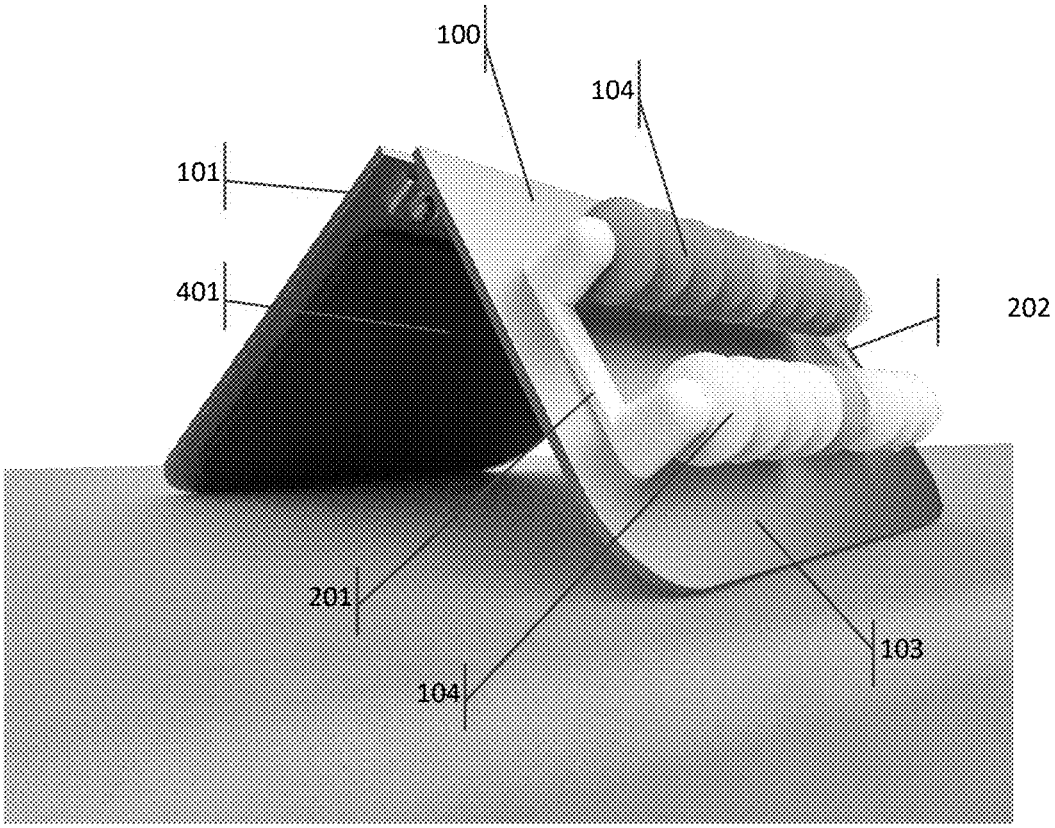
FIG. 4 shows another embodiment of the invention.

FIG. 4 shows another embodiment of the present invention, where Non-slip Pad 401 is attached to the bottom of Base Plane 101 to prevent slipping when Base Plane 101 rests on Pool Deck 106.

Figure 3:
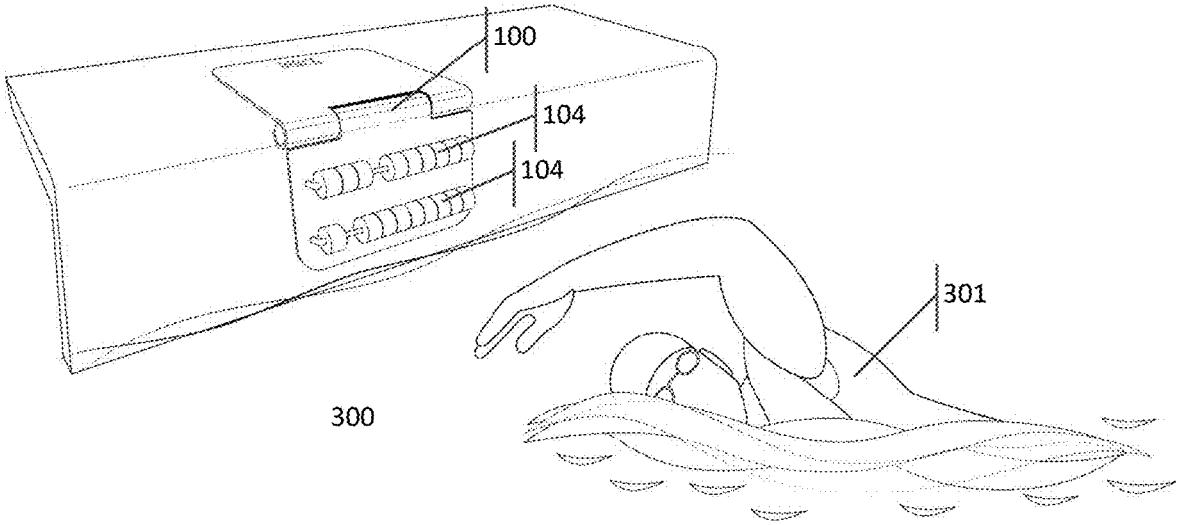
FIG. 3 shows the invention in use in a swimming pool.

FIG. 3 shows the lap counter in use in a swimming pool. Lap Counter 100 is situated on the edge of the pool at one end of Swimming Pool 300. When Swimmer 301 reaches the end of the pool where Lap Counter 100 is located, Swimmer 301 slides one slider on the right of lower Sliding Counter 104 to the left to indicate that another lap has been swum unless all nine sliders of lower Sliding Counter 104 are already on the left, in which case Swimmer 301 slides all nine sliders of lower Sliding Counter 104 to the right and slides one slider on the right of upper Sliding Counter 104 to the left to indicate the completion of another tenth lap swum.

In the preceding description, numerous details are set forth. It will be apparent, however, to one skilled in the art, that the present invention may be practiced without these specific details. In some instances, well-known structures and devices are shown in block diagram form, rather than in detail, in order to avoid obscuring the present invention.

We claim:

1. An apparatus for counting swim laps, comprising:

a horizontal finite planar surface configured to rest parallel to a pool deck;

a vertical finite planar surface, directly connected to said horizontal finite planar surface via one or more hinges, configured to rest parallel to a pool wall and perpendicular to the pool deck;

where said one or more hinges enable connection of said vertical finite planar surface to said horizontal finite planar surface and enables adjustment of the apparatus to the pool wall and the pool deck and also enable the apparatus to collapse for easy portability; and one or more manually sliding counters where both ends of each of said one or more manually sliding counters are attached to said vertical finite planar surface.

2. The apparatus of claim 1 including non-slip padding on the bottom of said horizontal finite planar surface.

3. An apparatus for counting swim laps, comprising:

a horizontal finite planar surface configured to rest parallel to a pool deck;

a vertical finite planar surface, directly connected to said horizontal finite planar surface via one or more hinges, configured to rest parallel to a pool wall and perpendicular to the pool deck;

where said one or more hinges enable connection of said vertical finite planar surface to said horizontal finite planar surface and enables adjustment of the apparatus to the pool wall and the pool deck and also enable the apparatus to collapse for easy portability;

one or more manually sliding counters where each end of each of said one or more manually sliding counters is attached to a tab; and where each tab is affixed to said vertical finite planar surface.

4. The apparatus of claim 3 including non-slip padding on the bottom of said horizontal finite planar surface.

* * * * *